US009440834B2

(12) United States Patent
Gabriele et al.

(10) Patent No.: US 9,440,834 B2
(45) Date of Patent: Sep. 13, 2016

(54) SELF-CENTERING AND SELF-GRIPPING CORKSCREW

(71) Applicant: LIFETIME BRANDS, INC., Garden City, NY (US)

(72) Inventors: Nathan Gabriele, Brooklyn, NY (US); Justin Dollinger, New York, NY (US)

(73) Assignee: LIFETIME BRANDS, INC., Garden City, NY (US)

( * ) Notice: Subject to any disclaimer, the term of this patent is extended or adjusted under 35 U.S.C. 154(b) by 225 days.

(21) Appl. No.: 14/072,960

(22) Filed: Nov. 6, 2013

(65) Prior Publication Data

US 2015/0122085 A1 May 7, 2015

(51) Int. Cl.
*B67B 7/04* (2006.01)

(52) U.S. Cl.
CPC ..... *B67B 7/04* (2013.01); *B67B 7/0441* (2013.01)

(58) Field of Classification Search
CPC ..... B67B 7/04; B67B 7/0441
USPC ..... 81/3.45, 3.29
See application file for complete search history.

(56) References Cited

U.S. PATENT DOCUMENTS 2,235,313 A 3/1941 Cleveland
4,135,415 A * 1/1979 Liebscher ..... B67B 7/0441 81/3.29
6,170,232 B1 1/2001 Vandegeijn
6,427,556 B2 * 8/2002 Fabbro ..... B67B 7/0441 81/3.37
7,832,307 B2 * 11/2010 Ferrari ..... B67B 7/0441 81/3.29
2007/0107555 A1 * 5/2007 Zhou ..... B67B 7/0447 81/3.37
2010/0206136 A1 8/2010 Cheung
2011/0308357 A1 12/2011 Andina

OTHER PUBLICATIONS

International Search Report and Written Opinion for International Application No. PCT/US2014/063979, mailed on Feb. 20, 2015. (8 pages).

* cited by examiner

*Primary Examiner* — Hadi Shakeri
(74) *Attorney, Agent, or Firm* — Tutunjian & Bitetto, P.C.

(57) ABSTRACT

A self-centering and self-gripping corkscrew is provided. A centering and locking mechanism is integrated into the bottle receiving opening of the corkscrew such that in one downward motion a bottleneck is securely gripped and automatically centered under the cork removing device (e.g., a worm screw). The centering and gripping mechanism is spring biased downward and utilizes compression techniques configured into an outer mechanism (contained within the bottle receiving opening of corkscrew) and the body of the corkscrew to simultaneously grip and align the bottle with the axis of the cork removing device. The locking mechanism is part of the centering mechanism and allows the corkscrew to remain locked onto the bottleneck (after centering and gripping) during activation of the cork removing device and removal of the corresponding cork. An upward motion opposite the locking motion disengages the mechanism, removing the corkscrew from the bottle.

7 Claims, 5 Drawing Sheets

SELF-CENTERING AND SELF-GRIPPING CORKSCREW

BACKGROUND

1. Technical Field

The present principles relate to corkscrews. More particularly, it relates a self-centering and self-gripping corkscrew.

2. Related Art

Corkscrews come in many different shapes and sizes. Among the most common of corkscrews is a "winged" corkscrew where the arms or handles move in conjunction with the worm as it engages the cork. These winged corkscrews have a bottom opening that the user places on the corked bottle and then manually engages the knob to rotate the worm into the cork. As the worm proceeds into the cork, the winged arms or handles rise upward. Downward pressure on the handles causes the ledge in the bottom opening to contact the top of the bottle and thereby extract the cork from the same.

Several drawbacks with known winged corkscrew designs exist. One of which is that the user must hold the device in engagement with the top of the bottle while simultaneously rotating the worm using the knob. This is primarily because the bottom opening is sized to receive most any size bottle and remains loose around the neck of the bottle until the worm engages the cork. However, those of ordinary skill in the art will also appreciate that the loose bottom receiving opening more often than not causes the worm to engage the cork "off-center" from the same. This results in a crooked engagement with the cork, and sometimes even causes the worm to breach a side of the cork, thus creating cork pieces that can fall into the bottle.

The self-centering and griping corkscrew of the present principles overcomes all the shortfalls of known winged corkscrew designs.

SUMMARY

According to an implementation, the corkscrew includes a self-centering and self-gripping mechanism positioned within a bottle-receiving opening of the corkscrew. The self-centering and self-gripping mechanism is configured to receive, secure and center a bottleneck received therein with a cork-removing device of the corkscrew.

According to another implementation, the corkscrew includes a body having a bottle receiving opening. A cork-removing device is positioned within the body. A self-centering and self-gripping mechanism is positioned within the bottle-receiving opening of the body, and is configured to receive, secure and center a bottleneck received therein with the cork-removing device.

According to yet another implementation, the corkscrew includes a body having a bottle receiving opening. A cork-removing device is positioned within the body and has an axis along which the cork-removing device travels. A self-centering and self-gripping mechanism is positioned within the bottle-receiving opening of the body, and is configured to receive, secure and center a bottleneck received therein with the cork-removing device.

These and other aspects, features and advantages of the present principles will become apparent from the following detailed description of exemplary embodiments, which is to be read in connection with the accompanying drawings.

BRIEF DESCRIPTION OF THE DRAWINGS

The present principles may be better understood in accordance with the following exemplary figures, in which.

DETAILED DESCRIPTION

The present principles are directed to corkscrews for removing corks from corked bottles.

The present description illustrates the present principles. It will thus be appreciated that those skilled in the art will be able to devise various arrangements that, although not explicitly described or shown herein, embody the present principles and are included within its spirit and scope.

All examples and conditional language recited herein are intended for pedagogical purposes to aid the reader in understanding the present principles and the concepts contributed by the inventor(s) to furthering the art, and are to be construed as being without limitation to such specifically recited examples and conditions.

Moreover, all statements herein reciting principles, aspects, and embodiments of the present principles, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

Reference in the specification to "one embodiment" or "an embodiment" of the present principles, as well as other variations thereof, means that a particular feature, structure, characteristic, and so forth described in connection with the embodiment is included in at least one embodiment of the present principles. Thus, the appearances of the phrase "in one embodiment" or "in an embodiment", as well any other variations, appearing in various places throughout the specification are not necessarily all referring to the same embodiment.

Figure 1:
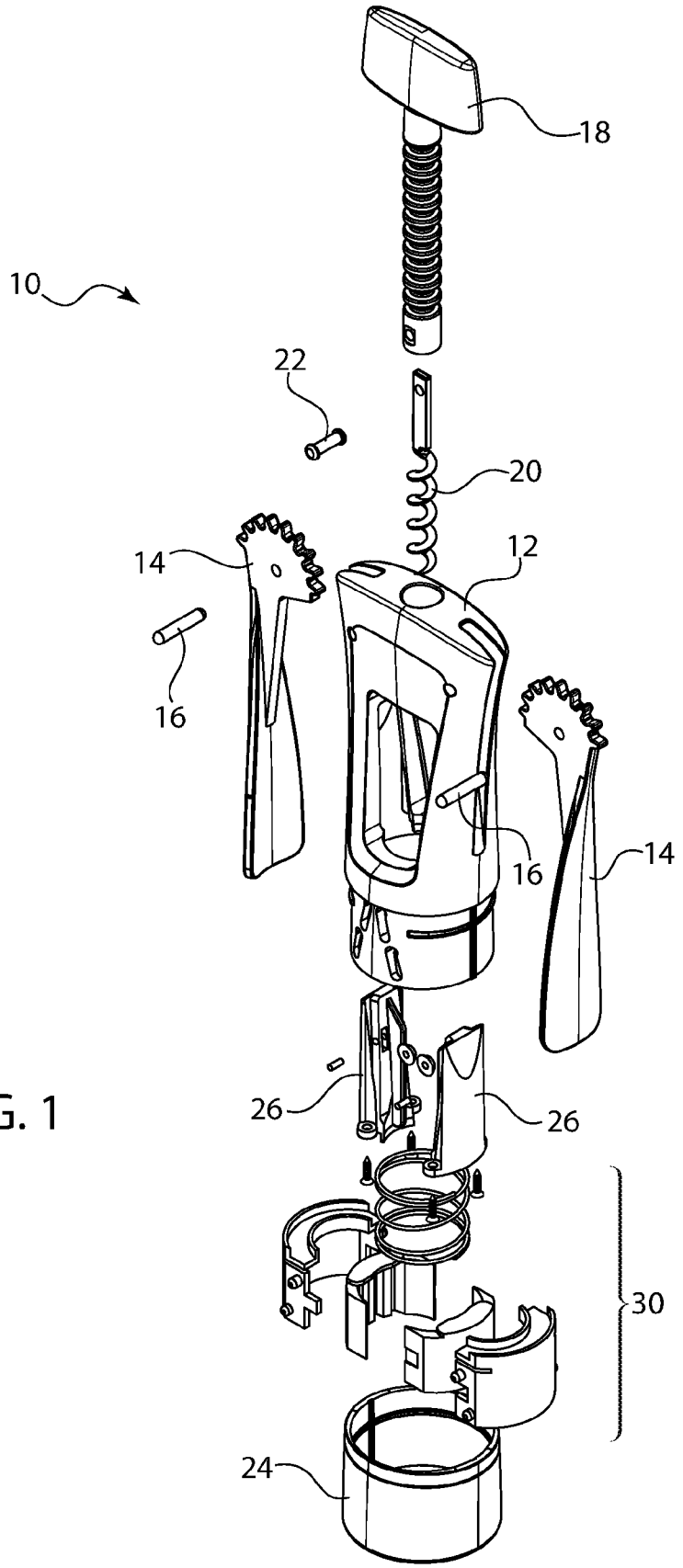
FIG. 1 is an exploded perspective view of the corkscrew according to an implementation of the present principles.

In accordance with the exemplary embodiment shown in FIG. 1, the self-centering/self-gripping corkscrew 10 includes several known and familiar parts. A body 12, includes the oppositely positioned arms 14 which are held in place by corresponding pins 16. The worm 20 is connected to the handle or knob 18 via a worm pin 22. The left and right cores 26 are positioned within the body around the worm 20. According to one preferred implementation, the self-centering/self-gripping corkscrew mechanism 30 is positioned within the bottle receiving opening on the bottom of the corkscrew. Once assembled, the bottom cover 24 encloses the bottom of the corkscrew and any remaining visible portions of the self-centering/self-gripping corkscrew mechanism 30. Although shown with a worm 20, those of skill in the art will appreciate that other cork removing devices could be implemented without departing from the intended scope of the present principles. For example, an auger could replace the worm, or alternatively, a needle capable of piercing the cork and delivering air into the bottle to force the removal of the same.

Figure 2:
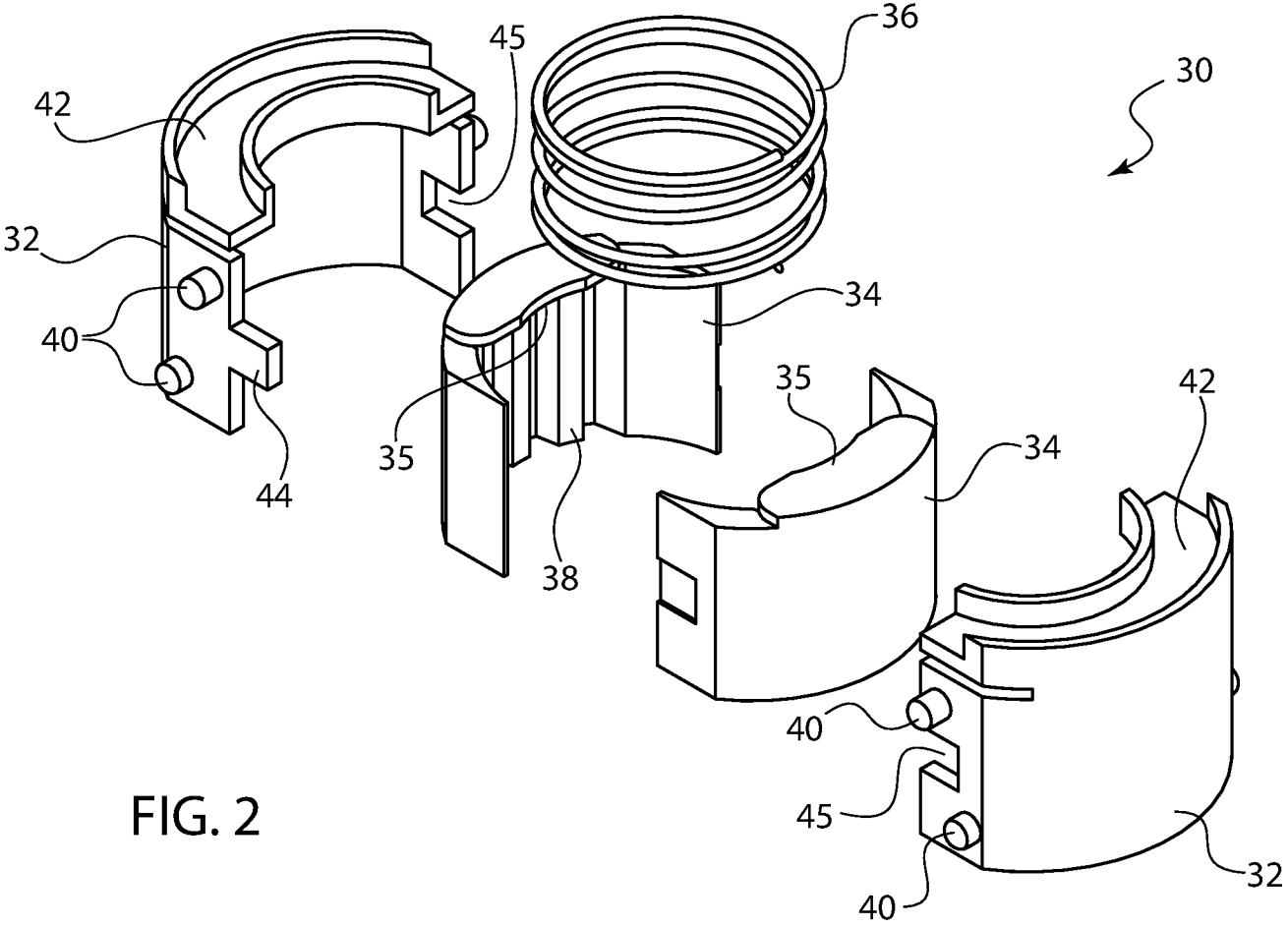
FIG. 2 is an enlarged exploded perspective view of self-centering and self-gripping mechanisms of the corkscrew according to an implementation of the present principles.

Referring to FIG. 2, the details of the self-centering/self-gripping corkscrew mechanism 30 are shown. The self-centering/self-gripping corkscrew mechanism 30 includes an inner pair of compression fittings 34 and an outer pair of compression fittings 32. The inner pair of fittings 34 having a soft bottleneck-engaging surface that can be made of any suitable flexible material, such as, for example, rubber, nylon, silicone, TPE, foam, etc. and a bottle top engaging flange 35. The outer pair of fittings 32 fit around the inner pair 34, and includes a plurality of pins 40 which cooperate with slots in the body and the spring 36 to self-center and lock/grip the corkscrew onto the neck of the corked bottle. The upper surface 42 of the outer fittings 32 is configured to receive and seat the bottom of the spring 36. Although the exemplary embodiment is shown with a winged corkscrew design, those of skill in the art will appreciate that the principles discussed herein can be applied to any corkscrew having an appropriate body and cork removing device.

Figure 3B:
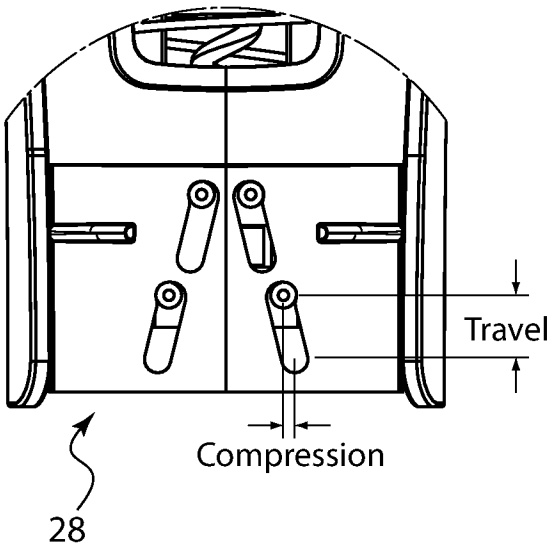
FIG. 3B shows a schematic view of the self-centering and self-gripping features of the corkscrew in the engaged or locked position around the top of a corked bottle, according to an implementation of the present principles.

The details of the operation of the self-centering and self-gripping/locking corkscrew will now be described in conjunction with FIGS. 3-5.

Figure 3A:
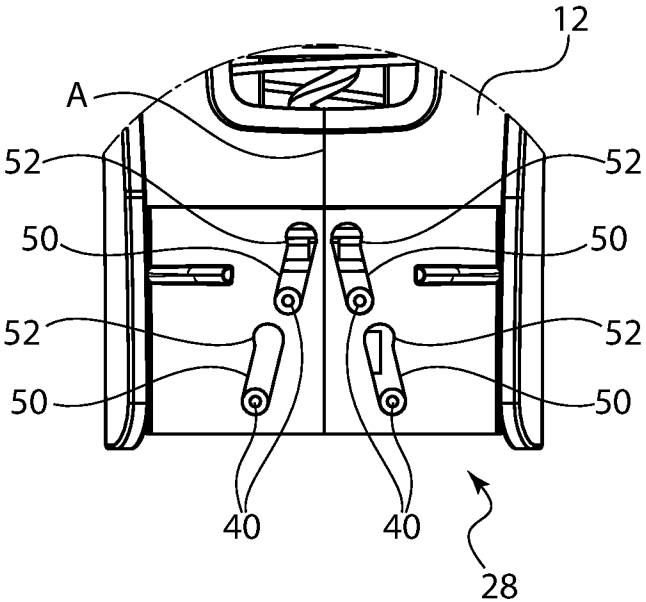
FIG. 3A shows a schematic view of the self-centering and self-gripping features of the corkscrew in the relaxed, un-engaged position, according to an implementation of the present principles.
Figure 4A:
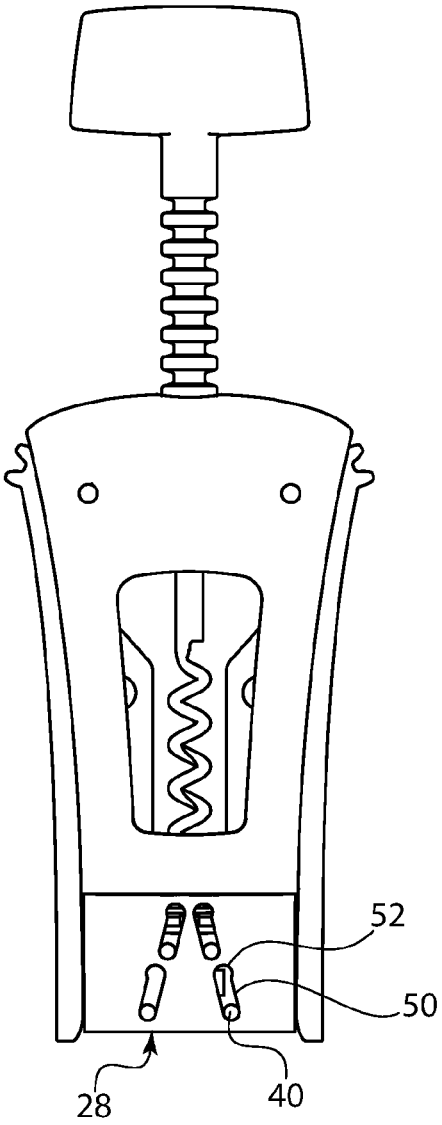
FIGS. 4A and 4B show the corkscrew of FIGS. 3A and 3B with the bottom cover removed, according to an implementation of the present principles.

Referring to FIGS. 3A-4B, the body 12 of the corkscrew includes slots 50 which, as shown, are angularly configured toward an axis A of the worm 20. The angular configuration of the slots 50 provide for the gripping of the bottleneck by compressing the inner mechanism part 34 around the bottleneck. The posts 40 on the respective outer pair of fittings are configured to be positioned within the slots 50. As shown in FIGS. 3A and 4A, the posts 40 are positioned at the bottom of each slot 50, thus indicating the relaxed or un-engaged position of the same. At the top of each slot 50 is a slight offset 52 which is part of the locking system.

Referring to FIG. 2, when assembled, the tabs 44 of fittings 32 fit into the slots 45 of the opposing fittings 32 so that fittings 32 remain vertically constrained to one another.

Figure 4B:
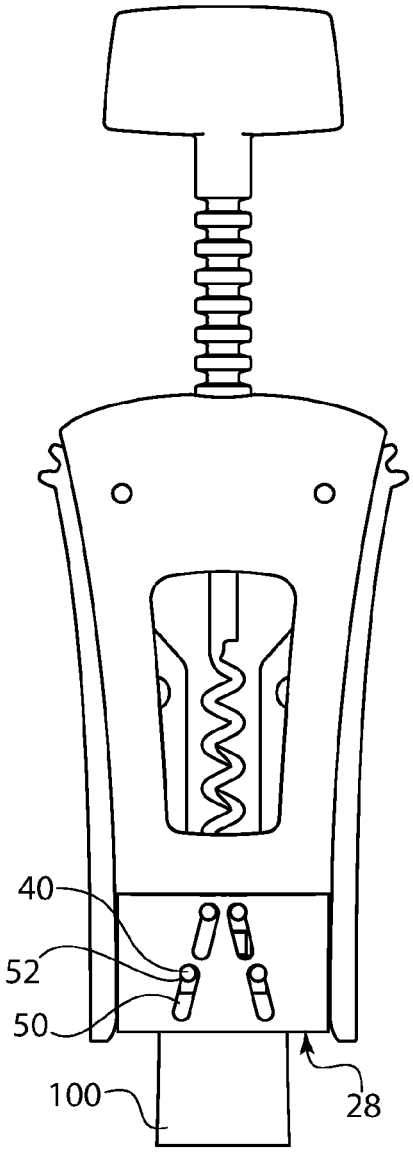

As shown in FIGS. 3B and 4B, when the top of a corked bottle is received and the corkscrew is pressed down on the same, several things occur: 1) the top of the bottle contacts the bottle-top-engaging flanges 35; 2) as the corkscrew is pushed downward, the posts 40 are caused to ride up the slots 50, thus causing the outer 32 mechanism (and thereby the inner mechanism 34 to be urged inward toward the center plane, which results in the inner mechanism 34 engaged around the bottleneck; and 3) at the top of the slots 50, the posts 40 "snap" or "lock" into the slot offsets 52. FIGS. 3B and 4B show the corkscrew in the engaged or locked position with a bottleneck 100 locked therein. The length or "travel" of the slots 50 are a matter of design choice, however, in this configuration, the average travel of the slots 50 is 8.5 mm. Thus, it will be apparent from the foregoing, that the slots 50, in conjunction with posts 40 of the outer 32 mechanism allow the bottleneck to be compressed by the inner mechanism 34 in a manner that guarantees the same to be centered with respect to the cork removing device axis A (i.e., the worm 20) every time. The compression performed by the angular disposition of the slots 50 with locking offset 52, can be, for example, 1.5 mm. This compression can be changed in accordance with the angle of the slots 50 and also considering the softness or firmness of the interior engaging surface 38 of the inner mechanism parts 34.

In accordance with other implementations, the posts 40 and the slots 50 can be reversed as to their disposition. Alternatively, the posts 40 and slots 50 can be replaced with structural equivalents such as, for example, a guide and a corresponding guide surface. For example, a guide of any shape and appropriate size can be positioned on the exterior surface of the outer mechanism parts 32, and a corresponding and mating inner guide surface can be disposed on an inside surface of the body such that the guide and inner guide surface cooperate to perform the desired compression/gripping and centering of the received bottleneck. Of course, in the alternative, the guide could be positioned on the inside surface of the body while the inner guide surface is integrated into the outer mechanism parts 32.

Figure 5A:
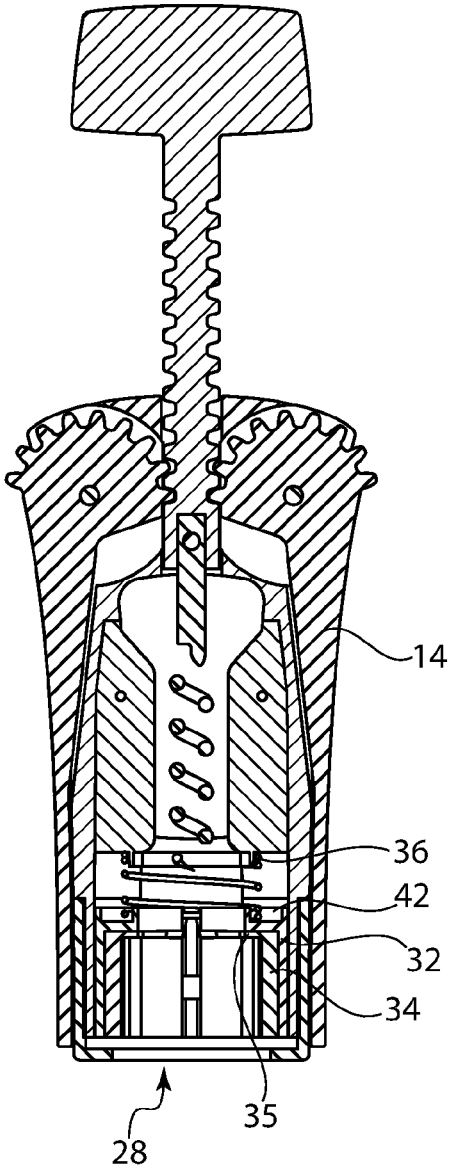
FIGS. 5A and 5B show cross-sectional view of the corkscrew in the relaxed, un-engaged position and the engaged position, respectively, according to an implementation of the present principles.
Figure 5B:
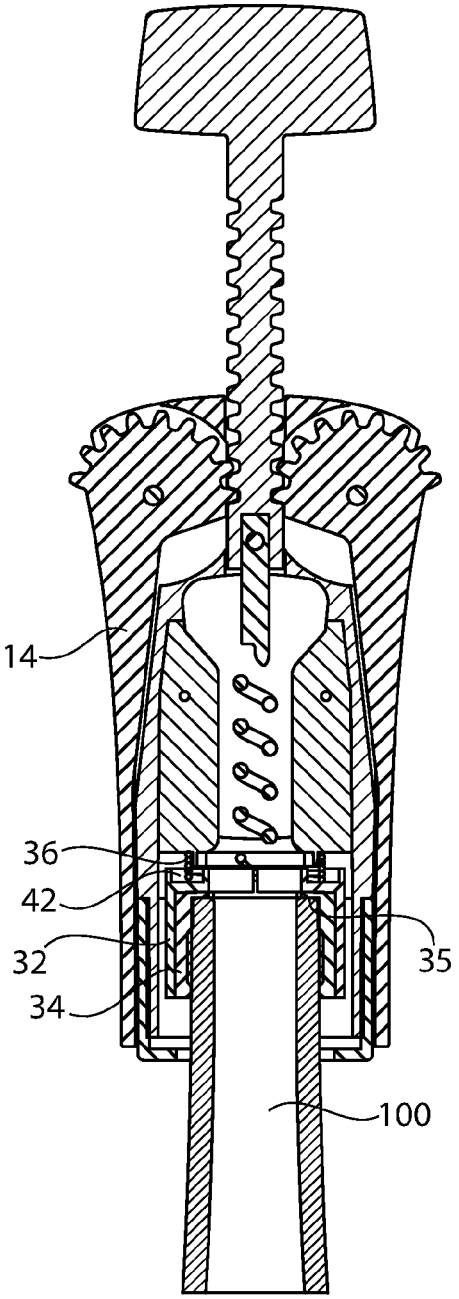

As shown in the cross-sectional views of FIGS. 5A and 5B, it will be apparent that the spring 36 biases the centering and gripping mechanisms downward. Thus, in the presence of downward pressure, the spring 36 compresses, while the posts 40 ride up the slots 50, which causes the outer mechanism 32 to compress around the inner compression fittings 34, which then compress around and against the bottleneck 100. When the posts 40 reach the top of slots 50 and snap or lock into the corresponding offsets 52, the corkscrew has now "gripped" the top of the bottle and is perfectly centered the same with the worm 20, and will remain there without any user assistance. The user can then engage the knob 18 and turn the worm into the cork. Once the worm engages the cork sufficiently to allow the use of the wing arms, the user can then withdraw the cork from the bottle.

During the withdrawal of the cork from the bottleneck, the posts 40 will remain engaged with the offsets 52, clamping the bottleneck. After the cork is completely removed, the user pulls the body upwards with sufficient force to override the offsets 52, removing the body 12 from the bottleneck. The bias of the centering and gripping mechanism from spring 36 causes the mechanism to return to the bottom position.

Those of skill in the art will appreciate that the corkscrew 10 and the parts thereof can be fabricated using one or more of many different materials. Examples of such materials include, but are not limited to, plastic, metal, wood, ceramic or any other structurally sound food-safe material.

These and other features and advantages of the present principles may be readily ascertained by one of ordinary skill in the pertinent art based on the teachings herein. It is to be understood that the teachings of the present principles may be implemented in various forms of hardware, software, firmware, special purpose processors, or combinations thereof.

Although the illustrative embodiments have been described herein with reference to the accompanying drawings, it is to be understood that the present principles is not limited to those precise embodiments, and that various changes and modifications may be effected therein by one of ordinary skill in the pertinent art without departing from the scope or spirit of the present principles. All such changes and modifications are intended to be included within the scope of the present principles as set forth in the appended claims.

What is claimed is:

1. A corkscrew comprising:

a body having a bottle receiving opening;

a cork-removing device positioned within the body; and a self-centering and self-gripping mechanism positioned within the bottle-receiving opening of the body, and being configured to receive, secure and center a bottleneck received therein with the cork-removing device;

the self-gripping mechanism comprising:

an inner mechanism configured to engage the bottleneck; and an outer mechanism concentrically positioned around the inner mechanism and configured to compress the inner mechanism around the bottleneck without requiring activation of the cork-removing device;

the self-centering mechanism comprising:

a centering and locking mechanism cooperatively formed into the body and the outer mechanism;

at least one guide positioned on the outer mechanism; and at least one guide surface integrated into or on the body and configured to receive the at least one guide on the outer mechanism, said at least one guide surface angularly extending toward an axis of the cork removing device.

2. The corkscrew according to claim 1, wherein said self-gripping mechanism further comprises:

a spring engaging a top surface of the outer mechanism and configured to bias both inner and outer mechanisms downward.

3. The corkscrew according to claim 1, wherein said locking mechanism comprises an offset in said at least one guide surface, said offset being positioned and configured to retain said at least one guide when it travels along the inner guide surface and engages the offset in the same.

4. A corkscrew comprising:

a body having a bottle receiving opening;

a cork-removing device positioned within the body and having an axis along which the cork-removing device travels; and a self-centering and self-gripping mechanism positioned within the bottle-receiving opening of the body, and being configured to receive, secure and center a bottleneck received therein with the cork-removing device;

the self-gripping mechanism comprising:

an inner mechanism configured to engage the bottleneck; and an outer mechanism concentrically positioned around the inner mechanism and configured to compress the inner mechanism around the bottleneck without requiring activation of the cork-removing device;

the self-centering mechanism comprising:

a centering and locking mechanism cooperatively formed into a body of the corkscrew and the outer mechanism;

at least one guide positioned on the outer mechanism; and at least one guide surface integrated into or on the body and configured to receive the at least one guide on the outer mechanism, said at least one guide surface angularly extending toward an axis of the cork removing device.

5. The corkscrew according to claim 4, wherein said self-gripping mechanism further comprises:

a spring engaging a top surface of the outer mechanism and configured to bias both inner and outer mechanisms downward.

6. The corkscrew according to claim 4, wherein said inner mechanism comprises a resilient inner bottle engaging surface configured to engage and grip the bottleneck.

7. The corkscrew according to claim 4, wherein said locking mechanism comprises an offset in said at least one guide surface, said offset being positioned and configured to retain said at least one guide when it travels along the inner guide surface and engages the offset in the same.

* * * * *